US006164220A

United States Patent [19]

Magnusson

[11] Patent Number: 6,164,220

[45] Date of Patent: Dec. 26, 2000

[54] ROTARY BURNER FOR SOLID FUEL

[75] Inventor: Jan Magnusson, Åmål, Sweden

[73] Assignee: Swedish Bioburner System Aktiebolag, Sweden

[21] Appl. No.: 09/202,828

[22] PCT Filed: Jun. 23, 1997

[86] PCT No.: PCT/SE97/01113

§ 371 Date: Sep. 16, 1999

§ 102(e) Date: Sep. 16, 1999

[87] PCT Pub. No.: WO97/49951

PCT Pub. Date: Dec. 31, 1997

[30] Foreign Application Priority Data

Jun. 25, 1996 [SE] Sweden ..... 9602495
Mar. 5, 1997 [SE] Sweden ..... 9700793

[51] Int. Cl.[7] ..... F23G 5/04; F26B 11/12

[52] U.S. Cl. ..... 110/246; 110/224; 110/226; 110/227; 110/228; 432/115; 34/182

[58] Field of Search ..... 110/234, 210, 110/213, 214, 224, 226, 227, 228, 235, 246, 254; 432/115, 264; 34/108, 599, 182

[56] References Cited

U.S. PATENT DOCUMENTS

| | | | |
|---|---|---|---|
| 1,583,436 | 5/1926 | Atkinson . | |
| 3,380,407 | 4/1968 | Nilsson . | |
| 3,433,186 | 3/1969 | Koecher | 110/14 |
| 3,513,788 | 5/1970 | Ostrin | 110/8 |
| 4,377,116 | 3/1983 | Satake | 110/235 |
| 4,470,358 | 9/1984 | Prochnow | 110/229 |
| 4,632,042 | 12/1986 | Chang | 110/243 |
| 5,145,362 | 9/1992 | Obermueller | 432/72 |
| 5,227,026 | 7/1993 | Hogan | 202/117 |
| 5,904,105 | 5/1999 | Pappinen | 110/226 |
| 5,927,970 | 7/1999 | Pate et al. | 432/115 |

FOREIGN PATENT DOCUMENTS

| | | | |
|---|---|---|---|
| 1526 056 | 2/1970 | Germany . | |
| 32 47 242 | 7/1983 | Germany | F23B 1/32 |
| 450 734 | 7/1987 | Sweden | F23B 1/32 |
| 2 079 910 | 1/1982 | United Kingdom | F23B 1/32 |
| 2198519 | 6/1988 | United Kingdom | 423/115 |
| 0 346 531 | 12/1989 | United Kingdom | F23B 1/32 |
| WO 94/17331 | 8/1994 | WIPO | F23B 1/32 |
| WO 95/29366 | 11/1995 | WIPO | F23K 1/04 |

*Primary Examiner*—Denise L. Ferensic
*Assistant Examiner*—Ken Reinhart
*Attorney, Agent, or Firm*—Kilpatrick Stockton LLP

[57] ABSTRACT

A device for combustion of granular material, for example wood flour pellets, chippings and the like, comprises a rotary solid fuel burner (1), air intake to the bumer, at least one conduit (18) for the supply of fuel and outlet (3) for combustion gases to a boiler part for heat transfer to water-cooled surfaces, for example. The rotary solid fuel burner is formed as a vessel with a rear wall, said outlet (3) for combustion gases and a jacket part between the rear wall and the outlet. A fuel feed pipe (18), which forms part of a fuel feed conduit, extends through the rear end wall, and an air admission pipe (19) surrounds the central fuel feed pipe at a distance from this, so that a space (20) which is ring-shaped in section is formed between the central fuel feed pipe (18) and the air admission pipe (19). Air admission ducts (17*b*, 17*a*), which communicate with said ring-shaped space (20), extend in a radial direction out towards the jacket part and further along this a part of the way in the direction of the outlet for combustion gases, which ducts are provided along their extension with openings (10) for the introduction of combustion air from said ducts into a combustion chamber (13) in the burner.

21 Claims, 3 Drawing Sheets

ROTARY BURNER FOR SOLID FUEL

TECHNICAL FIELD

The invention relates to a device for the combustion of granular material, for example wood flour pellets, chippings and the like, comprising a rotary solid fuel burner, air inlet to the burner and at least one conduit for feeding in fuel and outlet for combustion gases to a boiler section for heat transfer to water-cooled surfaces for example,

PRIOR ART

A device of the type specified above is known by way of my previous Swedish Patent 450 734.

BRIEF DESCRIPTION OF THE INVENTION

The aim of the invention is to provide a device of the type defined in the preamble, which is based on the same basic concept as the device according to my previous patent, which makes use of advantages of this earlier device but which includes essential improvements. Thus certain sealing problems in the case of the previous device have been eliminated in the new device, at the same time as the new device has become simpler to manufacture. These and other advantages can be achieved therein that the invention is characterized by what is specified in the appending claims.

Further features and aspects of the invention are apparent from the following description of a preferred embodiment.

BRIEF DESCRIPTION OF THE DRAWINGS

In the following description of a preferred embodiment, reference will be made to the accompanying drawings, of which

DESCRIPTION OF PREFERRED EMBODIMENT

Figure 1:
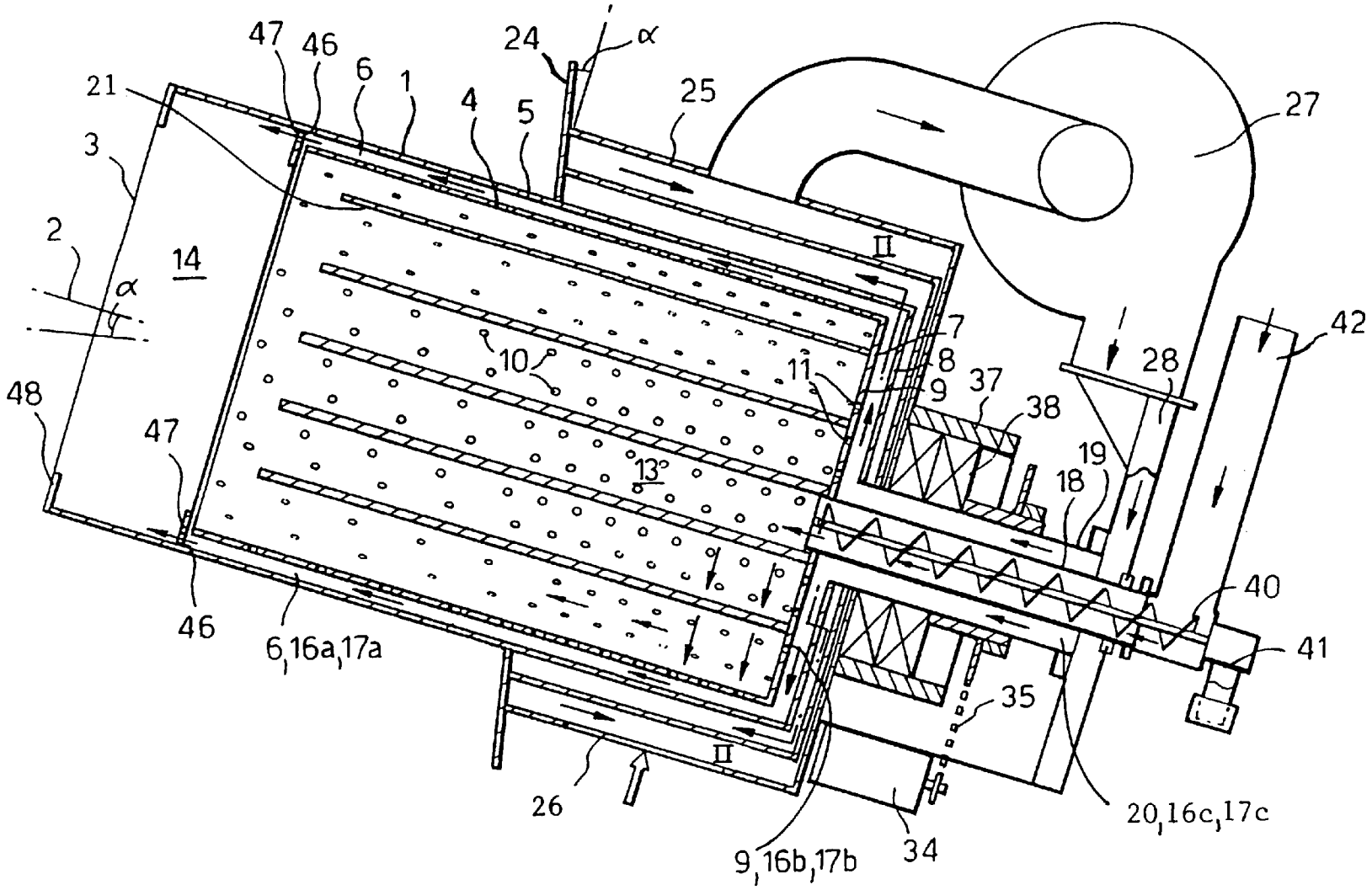
FIG. 1 shows partly diagrammatically a longitudinal section through the device according to a first embodiment.
Figure 2:
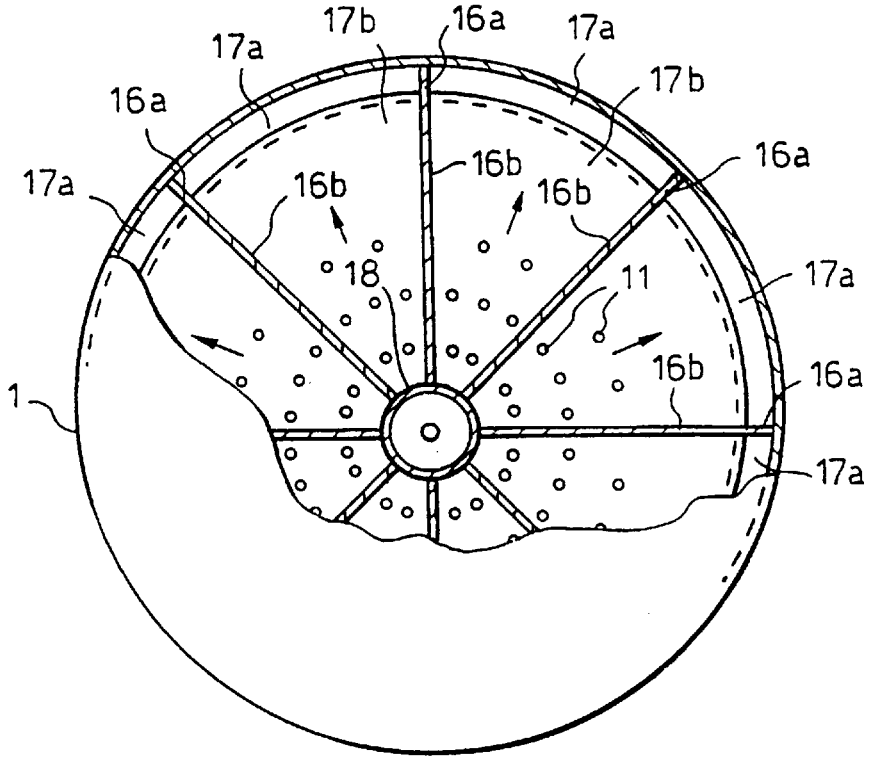
FIG. 2 represents a view along the line II—II in FIG. 1.

The solid fuel burner shown has the form of a drum, which has been generally designated 1 in FIG. 1 and FIG. 2. According to the embodiment, the drum 1 is circular-cylindrical and rotatable around a slightly inclined axis of rotation 2. The burner/drum 1 is positioned in connection to a heating boiler, which is not shown, and has at its front end an opening 3 for combustion gases. The rear end wall of the drum 1, like the main part of its cylindrical section, is double-walled. Located in the cylindrical double-walled part is an inner wall 4 and an outer wall 5 at a distance from the former. The space between these two walls has been designated 6. In a corresponding manner, the end wall has an inner wall 7, an outer wall 8 and a space 9 in between. The inner walls 4 and 7 are perforated by through holes 10 and 11 respectively. The area which is defined by the drum's double-walled section is here termed the main or primary combustion chamber 13, while the front, single-walled section of the drum is termed the after- or secondary combustion chamber 14. However, no restrictive significance shall be placed on these designations. The holes in the inner cylindrical wall 4 are disposed more closely in the rear part of the primary combustion chamber and distributed somewhat more sparsely in the front part. However, at the very front of the primary combustion chamber is a series of holes which are more closely distributed.

The space 6 between the cylindrical inner and outer walls 4, 5 is separated by longitudinal, radially aligned, lamella-shaped partition walls 16*a* into an equivalent number of longitudinal ducts 17*a*, which therefore have the shape of cylindrical segments. From a feed pipe 18 for the fuel an equally large number of lamella-shaped partition walls 16*b* extends out to the first-mentioned lamella-shaped partition walls 16*a* in the space 9 between the rear end walls 7 and 8, so that ducts 17*b* with the shape of a sector of a circle are formed between the partition walls 16*b* arranged like spokes in a wheel. The partition walls 16*a* and 16*b* pass into one another, as shown in FIG. 2, so that each duct 17*b* with the shape of a sector of a circle communicates with a longitudinal duct 17*a*, but only with one and not with any other such longitudinal duct.

The fuel feed pipe 18 is surrounded by a concentric, tube-shaped driving axle 19, which at the same time constitutes an air admission pipe. Located in the cylindrical space 20 between the feed pipe 18 and the driving axle 19 in the same manner as in the cylindrical space 6 are longitudinal, radially aligned partition walls 16*c*, which extend between the pipe 18 and the axle 19 along the entire length of the space 20 as far as the partition walls 16*b* in the space 9, so that longitudinal ducts 17*c* are formed between said walls 16*c* in the same manner as the ducts 17*a* between the walls 16*a* in the cylindrical part of the drum 1. Each partition wall 16*c* in the space 20 is thus connected to one and only one partition wall 16*b* in the space 9 in the same way as each partition wall 16*b* is connected to one and only one partition wall 16*a* in the space 6. Thus a system is created accordingly of ducts separated from one another, into a number of eight such ducts according to the embodiment, each of which extends from the rear end of the axle 19 via the spaces 20, 9 and 6 as far as the front end of the main combustion chamber 13, where the ducts are closed by a ring-shaped end wall 47.

The rear part of the drum 1, roughly corresponding to half the length of the drum, is surrounded by a double-walled casing 25, which is cut off obliquely in front at an angle corresponding to the angle of inclination of the drum and is completed by a flange 24 for mounting the device on a boiler opening by means of screws. The part of the device which is to the left of the flange 24 in FIG. 1 thus extends into the boiler, which is not shown, while the parts to the right of the flange 24 are located outside the boiler.

Figure 3:
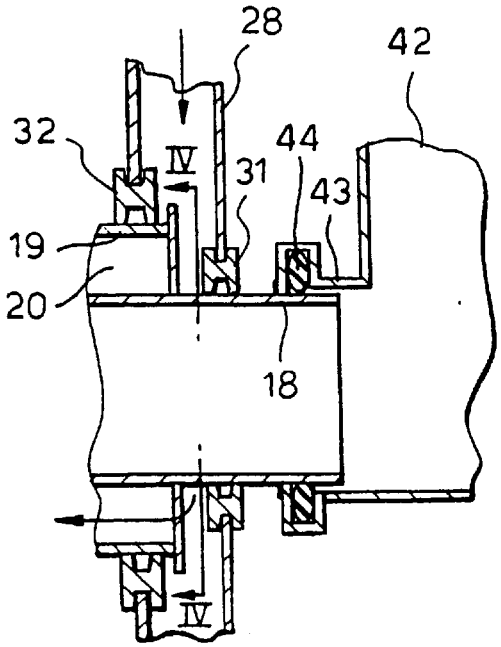
FIG. 3 shows a section of the device with certain sealing elements included in the device, on a larger scale.
Figure 4:
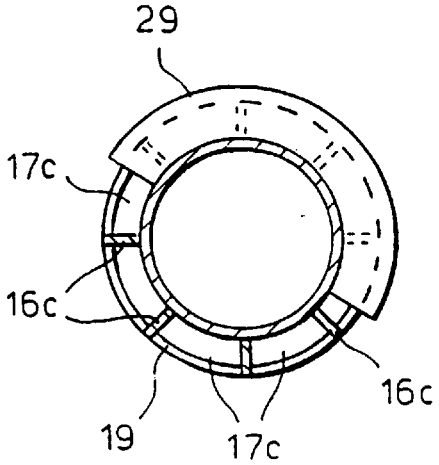
FIG. 4 represents a view along IV—IV in FIG. 3

In the lower part of the casing 25 is a number of slot-shaped openings 26 for cooling air, which is conveyed by a blowing fan 27 down into an air course 28. This communicates with the ducts 17*c*. Some of these, FIG. 4, can be shut off by means of a slide valve 29, so that one can choose selectively which of said ducts 17*c* the air is to be driven through. The air course 28 is sealed against the rotating fuel feed pipe 18 by a first ring-shaped rubber seal 31 and against the axle 19 by a second ring-shaped rubber seal 32, FIG. 3. Due to the fact that the area where the seals 31 and 32 are disposed is far from the seat of the fire and is also air-cooled, it is possible and expedient to use rubber as a sealing material, which gives a very good sealing effect.

The air admission pipe, i.e. the axle 19, and with it also the fuel feed pipe 18 and the entire drum 1—these parts are as is known connected to one another to form a continuous whole of great rigidity through the partition walls 16*c*, 16*b* and 16*a*—are rotated around its centre axis by means of of a drive motor 34 via a chain transmission 35. On the rear wall of the casing 25 is a bearing box 37 with ball bearings 38, in which the axle 19 is supported.

Located in the fuel feed pipe 18 is a feed screw 40, which is rotated by a drive arrangement 41 in the opposite direction relative to the direction of rotation of the axle 19 and the drum 1. A down pipe 42 for the fuel particles has at its lower end a connection portion 43 directed towards the feed pipe 18 and cantilevered on this. A seal 44, for example a graphite seal, is disposed between the connection piece 43 and the outside of the feed pipe 18, FIG. 3.

During operation, the drum 1 is rotated by means of the drive motor 34 via the transmission 35 and the axle/air admission pipe 19. The fuel is fed down through the down pipe 42 and driven further by means of the feed screw 40 into the main combustion chamber 13. The screw 40 is rotated in this connection as stated in the opposite direction relative to the axle 19 and at a higher speed than this, so that the fuel is driven forward very quickly through the feed pipe 18 to avoid a fire in the space 20/ducts 17*c*. At the same time, the blowing fan 27 sucks air in through the slots 26 in the casing 25. The air is preheated and driven down through the air course 28 and from there into the ducts 17*c* which are not shut off by the slide valve 29, which can be adjusted into various positions but is fixed during operation, normally selected so that the air is conveyed further into a number of the ducts 17*a* which will be situated successively in the lower part of the drum 1 during rotation of the drum. The air is conveyed through the openings 11 in the rear wall of the drum—more precisely in the lower part of this owing to the setting of the slide valve 29—and through the openings 10 in the area of the bottom part of the main combustion chamber 13 and in part up along the wall of the drum in the direction of rotation into the main combustion chamber 13 in the quantity required for the desired combustion. On rotation of the drum 1, the fuel is tumbled around in the drum by means of the lamellae 21, which are attached to the inside of the drum's inner wall 4, aligned radially, but is accumulated owing to the inclination of the drum preferably on the bottom of the lower part of the inclined drum 1. It shall also be said in this connection that the drum 1 does not necessarily have to be rotated continuously and at a constant speed. The speed can be varied depending on the needed effect and can also be intermittent. Variation between continuous rotation and intermittent rotation is also possible. The lamellae 21 extend forward from the rear wall 7 of the drum to a short distance from the front end of the main combustion chamber 13. Air also flows out through a number of openings 46 in the bottom part of the ring-shaped end wall, which bounds the space 6 forward and with it the ducts 17*a*. The secondary air which is thus blown out through the openings 46 maintains combustion in the after- or secondary combustion chamber 14, in particular combustion of products which have not completely combusted in the main or primary combustion chamber 13 but have passed out into the after-combustion chamber 14. There is also a ring-shaped barrier 48 at the very front so that these products shall not pass out unburnt through the opening 3.

In the rear part of the drum 1, i.e. in the inner part of the primary or main combustion chamber 13, where the distribution of air admission openings 10 is densest, and where in addition combustion air is blown in through the holes 11 in the rear wall, the temperature nevertheless remains relatively low, normally around 700–800° C., which is favourable from the environmental point of view with regard to the fact that this part of the burner is located outside the heat exchanger. In the front part of the drum, and in particular in the secondary or after-combustion chamber 14, where "fresh" combustion air is supplied through the holes 46 to whole but unburnt or incompletely burnt combustible products, the temperature can rise to between 1000–1300° C., typically to approx. 1250° C., which is favourable as this provides an efficient heat transfer into the convection part of the boiler, which is not shown.

Figure 5:
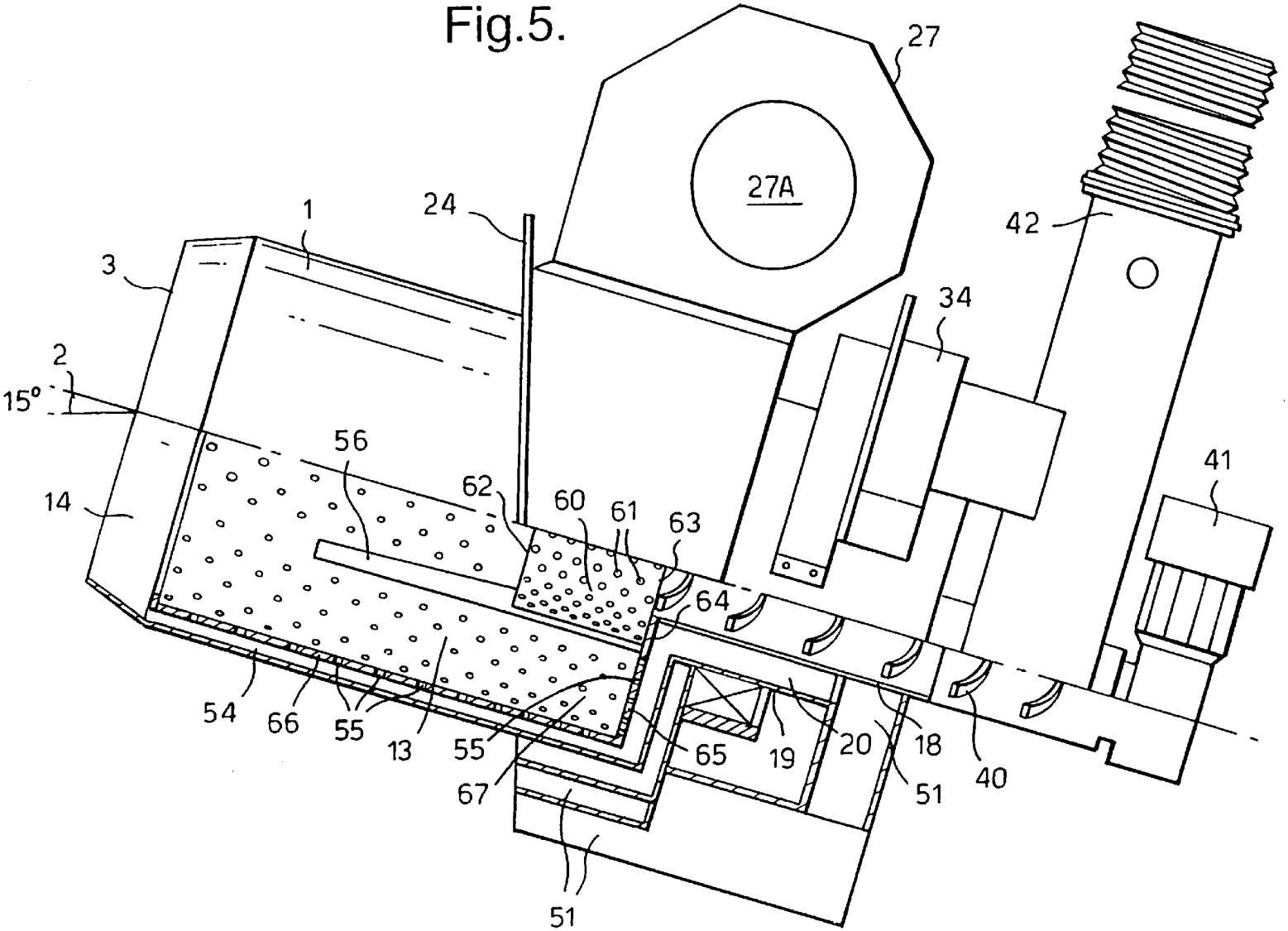
FIG. 5 shows a longitudinal section through the device according to a further improved version of the invention.

In the case of the device shown in FIG. 5, the same reference symbols have been used as in FIGS. 1–4 for corresponding details. The device shown in FIG. 5 consists therefore of the following main parts: a reactor drum 1, the inside of which forms a main or primary combustion chamber 13, an after- or secondary combustion chamber 14, a blowing fan 27 for combustion air, a feed screw 40 in a fuel feed pipe 18 for solid fuel in particle form, a motor 41 for rotation of the feed screw 40, a driving device 34 for rotating the reactor drum 1 around an inclined axis of rotation 2, a down pipe 42 for the fuel and air conduits, here designated 51, for the combustion air. The angle of inclination of the reactor drum 1 in relation to the horizontal plane, with the reactor drum's front opening 3 for combustion gases directed obliquely upwards, amounts to 15°.

The rear end wall 65 of the reactor drum 1, like the main part of its cylindrical section 66, is double-walled. The space between the inner and outer walls has been designated 54. The inner wall is provided with holes 55 both in the cylindrical part and in the rear end part for admitting combustion air into the main combustion chamber 13. Furthermore, the intermediate space 64 is divided into ducts as described in detail above. The air which flows through these ducts can be regulated more distinctly by means of valve bodies so that the combustion air is admitted preferably or mostly into the parts of the main combustion chamber 13 where the fuel is accumulated. Activators 56 for stirring the fuel are also located on the inside of the reactor drum 1, which activators extend right back to the end wall 65 and accompany the rotation of the reactor drum 1.

A difference in relation to the preceding embodiment is that the air is taken in by the blowing fan 27 through an air intake 27A and is pushed via the air conduits 51 and via the slide valve, which is not shown, into the air admission pipe/axle 19 and from the inside of this 20 on into the ducts in the intermediate space 64 and finally through the holes 65 into the combustion chamber 13.

The characteristic feature of the invention however is in the first instance an inner, smaller drum 60 in the rear part of the reactor drum 1. The inner, smaller drum 60 is cylindrical and has a perforated jacket. According to the embodiment the drum consists of a sheet metal drum with holes in the jacket, but a net drum is also possible. The holes in the jacket are designated 61. These are so small—the diameter or maximum extension length amounts to a maximum of 10 mm, preferably to a maximum of 8 mm—that the fuel particles cannot pass through them to any considerable degree. At the front the drum 60 is completely open. This opening is designated 62. The drum 60 is coaxial with the reactor drum 1 and surrounds a central feed opening 63 which forms an orifice on the feed tube 18 for the fuel, which is fed in by the feed screw 40. The diameter of the drum 60 is somewhat larger than the opening 63. In the ring-shaped space 64 between the feed opening 63 and the drum 60 the rear end wall 65 of the reactor drum 1 lacks inlet openings for combustion air. However, an alternative of this kind is also possible, thus air admission openings in said ring-shaped space 64 also. The drum 60 is welded to the rear end wall of the reactor drum 1.

During operation, the reactor drum 1 is rotated and with it also the inner drum 60, at the same time as fuel is fed through the central opening 63 by means of the feed screw into the smaller, inner drum 60. The fuel gradually falls through the front opening 62 and down towards the wall of the reactor drum 1 and further down into the space 67 between the reactor drum 1 and the inner drum 60 into the rear part of the main combustion chamber 13. The fuel in the main combustion chamber 13 is burnt by means of the primary air which is blown in through the openings 55 in the jacket and in the rear end wall. The fuel which is gradually fed into the inner drum 60 is dried in this drum before continuing into the main combustion chamber. The inner drum 60 therefore functions as a pre-drier, in which the slight moisture which may remain in the fuel is eliminated to a considerable extent. In addition, the smaller drum 60 appears to function so that more fuel in the course of combustion can be accumulated in the main combustion chamber due to the fact that the ring-shaped space 67 is more or less filled with fuel which, by means of the activators 56 in joint action with the inner drum 60, also follows round in the rotation of the burner, which further increases the efficiency of the combustion device.

It must be realized that the device can be varied within the scope of the invention. For example, the rotating drum can be disposed completely horizontally whether it contains an inner, smaller drum or not. In this case, however, the drum should be made tapering, for example conically tapering, from the rear wall and forwards, so that the bottom of the drum has approximately the same angle of inclination as shown in the embodiments described, whereby the fuel will be accumulated in this case also on the bottom of the rear part of the drum, where the admission of primary air is concentrated. It is also possible to conceive of not having any sharp corners at the transition between the rear end wall and the side wall which corresponds to the jacket of the drum, but instead of a bevelled transition, for example. A most ideal form from certain viewpoints, however, has a burner which is entirely lacking in corners, for example a burner with the principal shape of an egg or pear cut off at both ends, in which the more pointed part is directed towards the outlet opening. In this case also the burner is double-walled with the intermediate space between the walls divided into ducts, or otherwise provided with ducts for the combustion air from the air intake pipe, which surrounds the central fuel feed pipe, and further out forwards.

What is claimed is:

1. Device for combustion of granular material, wood flour pellets, and chippings, comprising a rotary solid fuel burner (1), air inlet to the burner, at least one conduit (18) for feeding fuel and an outlet (3) for combustion gases to a boiler part for heat transfer to water-cooled surfaces, wherein the rotary solid fuel burner is formed as a vessel with a rear wall, said outlet (3) for combustion gases and a jacket part between the rear wall and the outlet, a fuel feed pipe (18), which forms part of a fuel feed conduit, extends through the rear end wall, an air admission pipe (19) surrounds the central fuel feed pipe at a distance from the central fuel feed pipe, so that a space (20) which is ring-shaped in section is formed between the central fuel feed pipe (18) and the air admission pipe (19), at least one air admission duct **(17*b*, 17*a*), which communicates with said ring-shaped space (20), extends in a radial direction out towards the jacket part and further along the jacket part of the way in the direction of the outlet for combustion gases, which duct is provided along a length of the duct with openings (10) for admitting combustion air from said duct into a combustion chamber (13) in the burner, means for feeding the fuel into the fuel feed pipe and for driving this through the pipe and through the rear end wall into the burner, means for introducing combustion air into said space (20) between the air admission pipe and fuel feed pipe, and means for rotating at least one of said fuel feed and air admission pipes, with at least one pipe connected to the burner and functioning as a driving axle for this burner, said burner being double-walled at both the rear wall and jacket part area of the combustion chamber with inner and outer walls (7/4, 8/5) characterized in that spaces (9, 6) between the inner and outer walls are divided to form a plurality of ducts (17*b*, 17*a*, which are delimited from one another by radial partition walls (16*b*) in the rear wall and by longitudinal partition walls (16*a*)** in the jacket part area of the combustion chamber.

2. Device according to claim 1, characterized in that the space (20) between the air admission pipe (19) and fuel feed pipe (18) is divided into a number of ducts **(17*c*) equivalent to the number of ducts in the burner, and that each duct (17*c*) in said space (20) between the air admission pipe (19)** and the fuel feed pipe can communicate with one and only one of the ducts in the burner.

3. Device according to claim 2, characterized in that the fuel is disposed to be fed into said fuel feed pipe (18) in the rear end of the fuel feed pipe, and that combustion air is disposed to be introduced into said space (20) between the air admission pipe (19) and the fuel feed pipe (18) in or close to the rear end of the air admission pipe (19).

4. Device according to claim 3, characterized in that a connecting conduit (28) for combustion air to said space (20) between the air admission pipe (19) and the fuel feed pipe (18) is sealed against at least one of said pipes (18, 19) by a seal (31, 32) in the rear part of the fuel feed pipe (18) and/or the air admission pipe (19).

5. Device according to claim 3, characterized in that a connecting conduit for fuel to the fuel feed pipe (18) is sealed against said fuel feed pipe by a seal (44) in the area of the rear part of the fuel feed pipe (18).

6. Device according to claim 1, characterized in that a slide valve (29) distributes the combustion air successively during the burner's rotation to a limited number of said ducts **(17*c*, 17*b*, 17*a*)**.

7. Device according to claim 6, characterized in that said slide valve (29) is in the rear end of the air admission pipe (19) between a connecting conduit (28) for combustion air and said space (20) between the air admission pipe (19) and fuel feed pipe (18).

8. Device according to claim 1, characterized in that the air admission pipe (19) constitutes a driving axle and is connected to the burner, and that the fuel feed pipe, which is connected to the air admission pipe through longitudinal partition walls **(16*c*) in the space (20) between the two pipes (19, 18)**, accompanies the rotation movement of the air admission pipe.

9. Device according to claim 8, characterized in that the fuel feed pipe is also directly connected to the burner.

10. Device according to claim 1, characterized in that said ducts **(17*a*, 17*b*) are disposed in the area of a main or primary combustion chamber (13), that between the primary combustion chamber and the outlet (3) for combustion gases is an after- or secondary combustion chamber (14) and that combustion air is disposed to be blown into the secondary combustion chamber (14) without passing through the primary combustion chamber (13**).

11. Device according to claim 1, characterized in that inside the burner, in the rear of the burner, is an inner vessel, which can have the form of a smaller drum (60), and that at least the majority of the fuel is disposed to be fed into the inner, smaller drum (60) and from this to the surrounding main or primary combustion chamber (13).

12. Device according to claim 11, characterized in that the inner drum (60) is coaxial with the burner (1).

13. Device according to claim 11, characterized in that the smaller drum (60) is disposed to rotate with the larger burner (1) around the latter's centre axis (2).

14. Device according to claim 11, characterized in that the external diameter of the inner drum (60) is at least a quarter and at most three-quarters of the internal diameter of the internal diameter of the burner.

15.Device according to claim 11, characterized in that the inner drum (60) has a length of at least a fifth and at most three-fifths of the burner's length.

16. Device according to claim 11, characterized in that the inner drum (60) is provided with openings (61) in its jacket part, which openings have a diameter or maximum extension length of 10 mm maximum, so that at least the majority of the solid fuel cannot pass through these openings but only through a front opening (62).

17. Device according to claim 11, characterized in that the burner (1) is inclined, so that the outlet (3) for combustion gases is turned obliquely upwards, due to which the fuel, when it leaves a front opening (62) of the inner drum (60), is essentially accumulated in a ring-shaped space (67) between the inner drum and the burner.

18. Device according to claim 17, characterized in that the angle of inclination of the bottom of the burner in relation to the horizontal plane is 5–30°.

19. Device according to claim 11, characterized in that openings (10, 11) for the admission of combustion air are located both in the area of the burner's rear end wall (66), at least outside the inner drum (60), and in the area between the end wall and the front outlet opening.

20. Device according to claim 19, characterized in that inlet openings for combustion air are lacking in a ring-shaped area (64) of the end wall, at the back of the inner, smaller drum (60), between a feed opening (63) for fuel and said smaller drum (60).

21. Device according to claim 1, characterized in that the burner has the form of a cylindrical tapering drum.

* * * * *